US005111634A

United States Patent [19]

Rauch

[11] Patent Number: 5,111,634

[45] Date of Patent: May 12, 1992

[54] PACKAGING STATION FOR A PACKAGING MACHINE, IN WHICH A STACK OF GOODS IS HOOPED WITH A PACKAGING TAPE

[75] Inventor: Wilhelm Rauch, Bindlach, Fed. Rep. of Germany

[73] Assignee: SMB Schwede Maschinenbau, Fed. Rep. of Germany

[21] Appl. No.: 661,665

[22] Filed: Feb. 27, 1991

[30] Foreign Application Priority Data

Mar. 8, 1990 [DE] Fed. Rep. of Germany ..... 4007264

[51] Int. Cl.[5] ..... B65B 13/06

[52] U.S. Cl. ..... 53/176; 53/589

[58] Field of Search ..... 53/176, 582, 589; 100/14, 16

[56] References Cited

U.S. PATENT DOCUMENTS

| | | | |
|---|---|---|---|
| 3,129,658 | 4/1964 | Valente | 100/14 X |
| 3,150,586 | 9/1964 | Snider . | |
| 3,174,631 | 3/1965 | Swihart . | |
| 3,304,960 | 2/1967 | Keusemann | 100/14 X |
| 3,783,773 | 1/1974 | Willard | 100/26 X |
| 3,955,491 | 5/1976 | McMahon | 100/14 X |
| 4,312,266 | 1/1982 | Pasic | 100/14 |
| 4,406,219 | 9/1983 | Mosa | 100/26 X |
| 4,533,033 | 8/1985 | van Wegen | 100/14 X |
| 4,578,933 | 4/1986 | Lang | 53/589 X |
| 4,769,970 | 9/1988 | Konno | 53/589 |
| 4,958,481 | 9/1990 | Kim | 53/176 X |

FOREIGN PATENT DOCUMENTS 1088420 9/1960 Fed. Rep. of Germany .

*Primary Examiner*—John Sipos
*Attorney, Agent, or Firm*—Laff, Whitesel, Conte & Saret

[57] ABSTRACT

A packaging machine, in which a stack of goods is hooped with a packaging tape, has a work table with a rotating disk consisting of individual sectors. These sectors have spaces relative to each other, which extend diametrically relative to the axis of rotation, and one of which is in each case situated above a guide channel for the packaging tape. Furthermore, devices are provided to lower a conveying device out of the vicinity of the rotating disk. As a result of these measures it is possible to hoop a stack of goods with several intersecting packaging tapes in a packaging station.

27 Claims, 3 Drawing Sheets

23
32
33
26
24
19
29
27
19
21
30
42
2
1
70
46
43
34
35
25
3
28
22
27
44
39
71
38
27
35
37
36
28
40
22
4
29
23

3
51
50
49
52
12
23
31
22
25
13
53
14
21
48
44
47'
30
17
24
46'
11
19
20
29
10
22
23
27
28
18
16
39
43
47
46
8
15
30
59
58
55
47
54
56
15
65
46
57
64
63
61
16
62
60
66
3
68
67
69

PACKAGING STATION FOR A PACKAGING MACHINE, IN WHICH A STACK OF GOODS IS HOOPED WITH A PACKAGING TAPE

FIELD OF THE INVENTION

The invention relates to a packaging station of a packaging machine, in which a stack of goods is hooped with a packaging tape, with a work table to receive a stack of goods, with a conveying device to convey a stack of goods in a conveying direction into a hooping position and out of this position, and with a guiding device to guide the packaging tape around the stack of goods in an entering direction at right angles to the conveying direction, the work table being provided with a guide channel to be opened towards the stack of goods and extending at right angles to the conveying direction.

BACKGROUND OF THE INVENTION

Packaging stations of the generic kind are primarily used to hoop a stack of journals with an elastic packaging tape of plastics material, which is tensioned and the ends of which are welded together. Such packaging stations have a work table with a guide channel, which can be opened towards the stack of goods and which is completed to form a closed guideway laterally above the work table and over it, these guideway sections located above the work table being formed in a guide frame. Drivable conveying belts are provided ahead of and behind the guide channel for the packaging tape in conveying direction and serve to convey a stack of goods centrally via the guide channel or to continue conveying it in conveying direction after it has been hooped with a packaging tape. If a stack of goods is to be hooped with intersecting packaging tapes, then the stack of goods hooped with a packaging tape is rotated by 90° on a rotating disk arranged subsequent to a first packaging station and is then conveyed to a similar second packaging station. This known construction requires two corresponding packaging machines and an intermediate rotary device, which is of disadvantage from the point of view of mechanical expenditure and of floor space required.

SUMMARY OF THE INVENTION

It is accordingly the object of the invention to embody a packaging station such that a stack of goods with several intersecting packaging tapes can be hooped in it.

In accordance with the invention this object is attained in a packaging station of the generic kind by the work table being at least partially formed by a rotating disk, which can be driven to rotate about an axis of rotation, and which consists of at least four sectors having at least two spaces, which extend diametrically relative to the axis of rotation, and of which one is in each case situated above the guide channel, and by devices being provided to lower the conveying device out of the vicinity of the rotating disk. The core of the invention consists in that being hooped with a first packaging tape the stack of goods is rotated in the packaging station and then hooped with a further packaging tape, it also being basically possible to provide three hoopings or more. But as a rule two hoopings are sufficient, i.e. the stack of goods is rotated by 90° between the hooping operations. The conveying device can be lowered so as to enable the rotating disk to rotate. The embodiment of sectors forming the rotating disk has the consequence that in each position of rotation provided for a hooping operation the guide channel for the packaging tape remains completely open towards the stack of goods so that after being welded the packaging tape can cling to the stack of goods and the stack of goods can be further conveyed.

A particularly simple way of positioning the sectors of the rotating disk is achieved when the sectors are supported in guideways of the work table formed concentrically relative to the axis of rotation. When only one sector can be driven to rotate, and when the sectors are coupled with each other by means of driving devices bridging the spaces and movable out of the vicinity of the spaces, it is nevertheless ensured that the guide channel is free towards the stack of goods.

Further details, advantages and features of the invention will become apparent from the ensuing description of an example of embodiment of the invention taken in conjunction with the drawings.

DESCRIPTION OF THE PREFERRED EMBODIMENT

Figure 1:
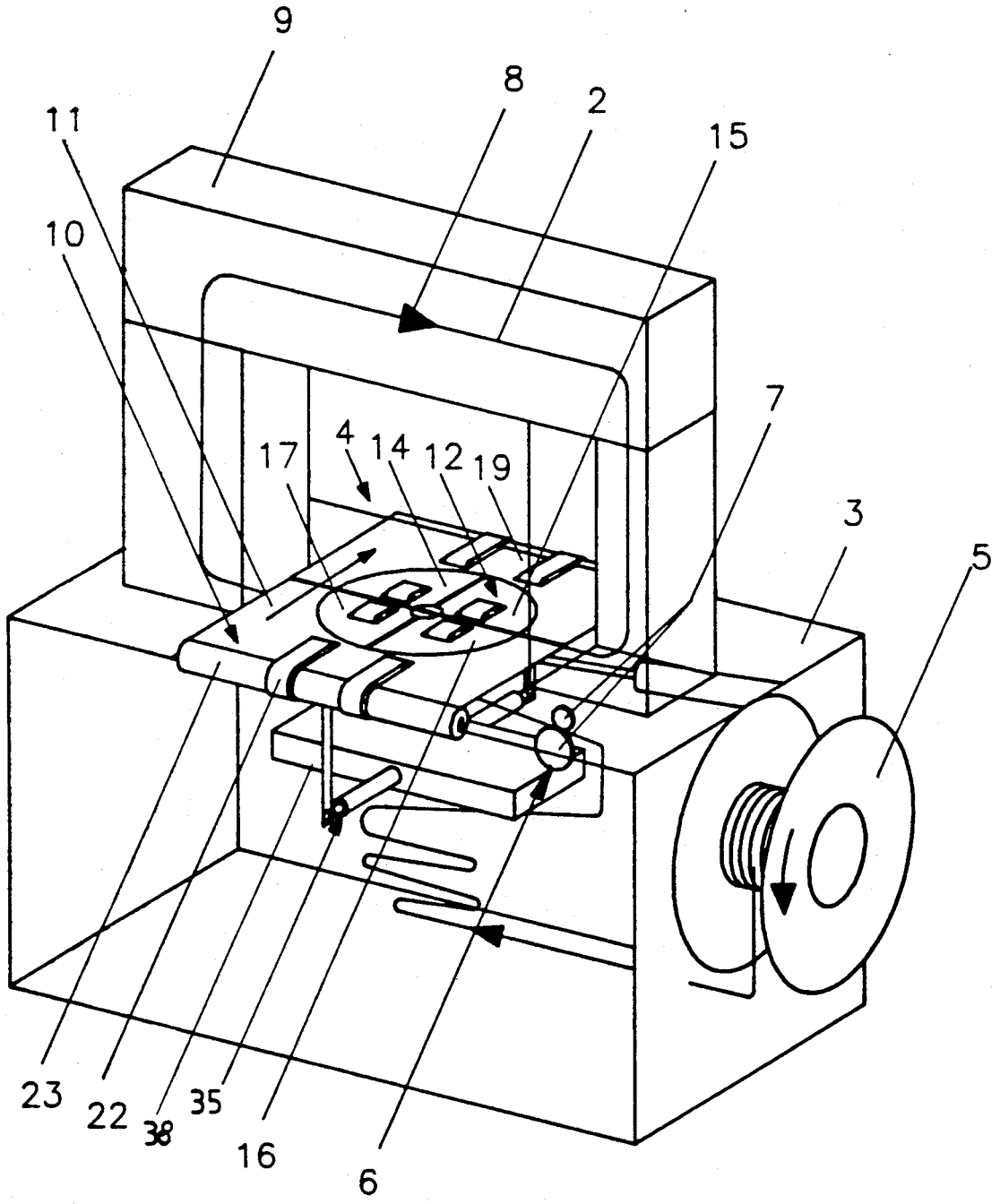
FIG. 1 is a diagrammatic, perspective view of a packaging machine with a packaging station according to the invention.
Figure 2:
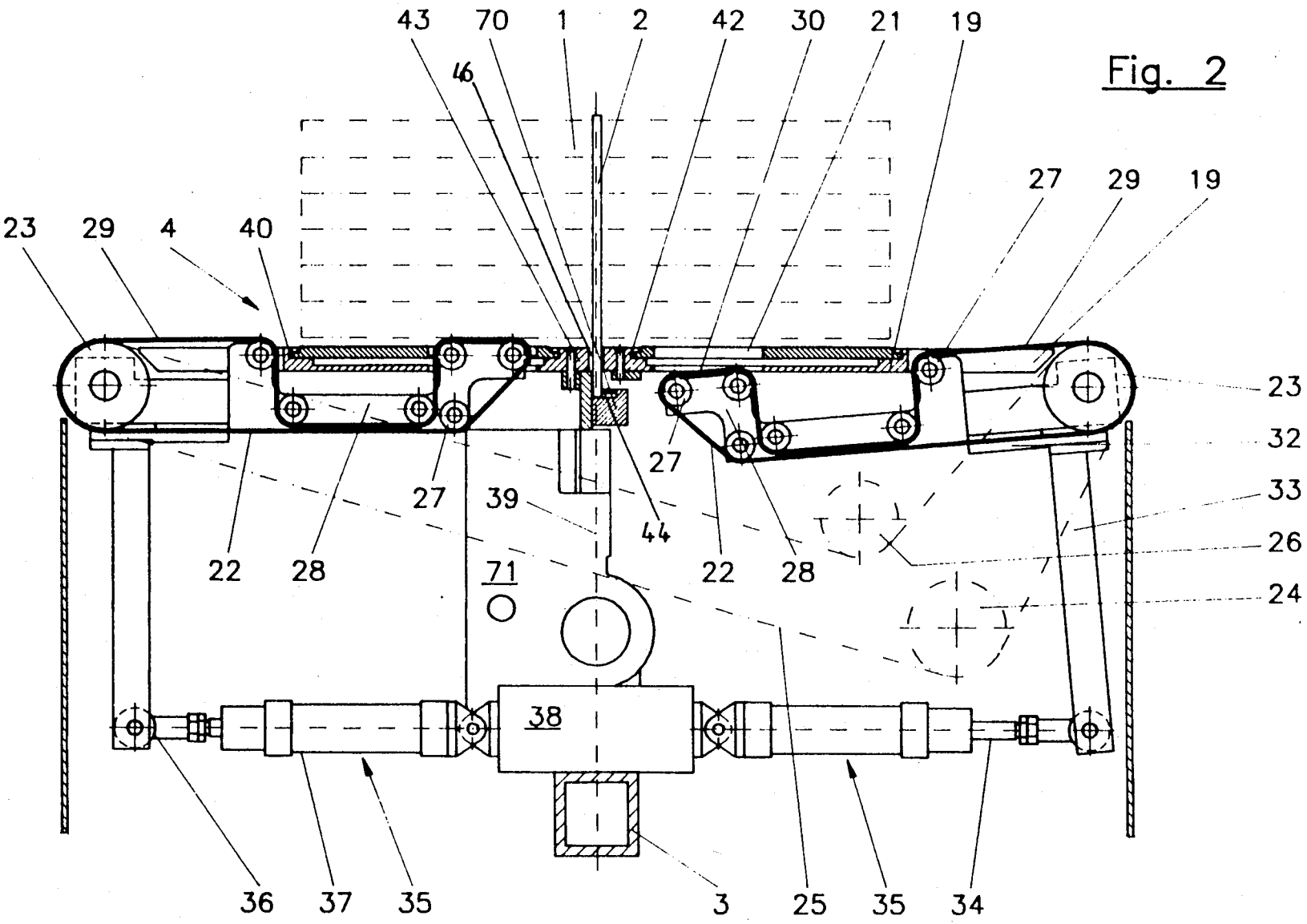
FIG. 2 is a cross-section through the packaging station mainly showing the conveying devices.

A packing machine, in which stacks of goods 1—preferably stacks of journals—roughly outlined in FIG. 2 are hooped with a packaging tape 2, has a lower approximately cuboidal machine frame 3 and a packaging station 4 arranged on the latter. A supply coil 5 is secured to a side of the frame 3 and the packaging tape 2 is reeled off this coil and entered into the packaging station 4 by means of a so-called entering device 6 while loosely surrounding a stack of goods 1. The entering device 6 consists of a pair of rolls 7 drivable at high speed and of a drive motor not shown in the drawing. By changing the direction of rotation of the pair of rolls 7 the tape 2, of which the free end is held in the packaging station 4, is pulled backwards against the direction of entering 8 to such extent that it clings to the stack of goods 1. When the tape 2 is entered, it is guided in a guide duct only roughly outlined in the drawing, which is formed in a guiding frame 9 provided on the frame 3. Such a packaging station as described above is generally known in practice and widely spread.

On the one hand, a conveying device 10 for conveying a stack of goods 1 in conveying direction 11 through the packaging station 4 is provided on the machine frame 3, and, on the other hand, a rotary device 12 is provided on it for rotating a stack of goods 1 by 90° in the direction of rotation 13, in order to hoop the stack of goods 1 with a packaging tape 2 in two directions in the only one packaging station 4.

The rotary device 12 has a rotating disk 18—to be specified below in more detail—comprising four plate-shaped sectors 14, 15, 16, 17 each in the form of a quarter of a circle. The rotating disk 18 is arranged in a work table 19 arranged on the frame 3. The work table 19 and the sectors 14 through 17 have recesses 20, 21 associated in pairs and extending in conveying direction 11, as can in particular be seen from FIG. 3.

The conveying device 10 has four conveying belts 22, of which two are arranged parallel to one another and two are arranged one behind the other in conveying direction 11. They are guided around drive shafts 23 provided on the frame 3 and driven by a common drive motor 24 arranged in the frame 3 by means of a common drive belt 25 guided over a deflection pulley 26 arranged in the frame 3—as can also be seen from FIG. 2.

The two conveying belts 22 arranged parallel to each other and associated with a drive shaft 23 are guided over a series of deflection pulleys 27, which are freely rotatably supported in a pivotable frame 28. They are guided over these deflection pulleys 27 in such a way that a conveying section 29 protrudes through the corresponding recess 20 in the work table 19 and that a further conveying section 30 protrudes through the corresponding recess 21 in the corresponding sector 14, 15, 16 or 17 of the rotating disk 18, as is in particular indicated on the left in FIG. 2. The corresponding conveying section 29 or 30, respectively, projects a little beyond the surface of the work table 19 or of the rotating disk 18, respectively.

Each pivotable frame 28 is pivotable about the axis 31 of the corresponding drive shaft 23. To this effect it is provided with a base plate 32, to which a downwards extending operating arm 33 is secured, on the lower end of which a piston rod 34 of a hydraulically or pneumatically actuatable piston cylinder drive 35 is in turn articulated by means of a hinge 36. The cylinder 37 of the corresponding piston cylinder drive 35 is in turn articulated on an abutment 38 of the frame 3. When the piston rod 34 is in its retracted position, the frame 28 with the corresponding conveying belt 22 is in its raised conveying position shown on the left in FIG. 2, in which the conveying section 29, 30 protrudes through the corresponding recesses 20, 21 beyond the surface of the work table 19 or the rotating disk 18, respectively. When the piston rod exits, the corresponding conveying belts 22 with the pivotable frame 28 are in their lowered position shown on the right in FIG. 2, in which the conveying sections 29, 30 are situated below the surface of the rotating disk 18 and the work table 19, i.e. in which they cannot force a stack of goods 1 situated on the rotating disk 18 to be conveyed in conveying direction 11, and in which in particular they cannot interfere with any rotating movements of the rotating disk 18.

With their outer circumference the four sectors 14, 15, 16, 17 of the rotating disk 18 are on the one hand guided in a guide groove 40 of the work table 19 arranged concentrically relative to the axis of rotation 39 of the rotating disk 18. On their side neighbouring the axis of rotation 39 they are further guided in a corresponding guide groove 42 also arranged concentrically relative to the axis of rotation 39. This guide groove 42 is formed in a stationary centre portion 43 of the work table 19, which portion is non-rotating relative to the machine frame 3.

A guide channel 44 for the packaging tape 2 to be opened upwards is provided below the work table 19, below the sectors 14 through 17 and below the stationary centre portion 43, and extends at right angles to the conveying direction 11, through which guide channel 44 the packaging tape 2 having passed through the guide duct in the guiding frame 9 is entered in entering direction 8. In the vicinity of the rotating disk 18 the guide channel 44 can be completely open upwards, among other things due to the fact that the sectors 14 through 17—as can in particular be seen from FIG. 3—are arranged in such a way that a space 46 or 46', respectively, is left free between them. The four sectors 14 through 17 are connected with one another by way of driving devices 47, 47', so that, when a sector 14 is pivoted in the direction of rotation 13 by an angle of rotation of 90°, the space 46 or the space 46', alternately, is above the guide channel 44.

Figures 3, 4:
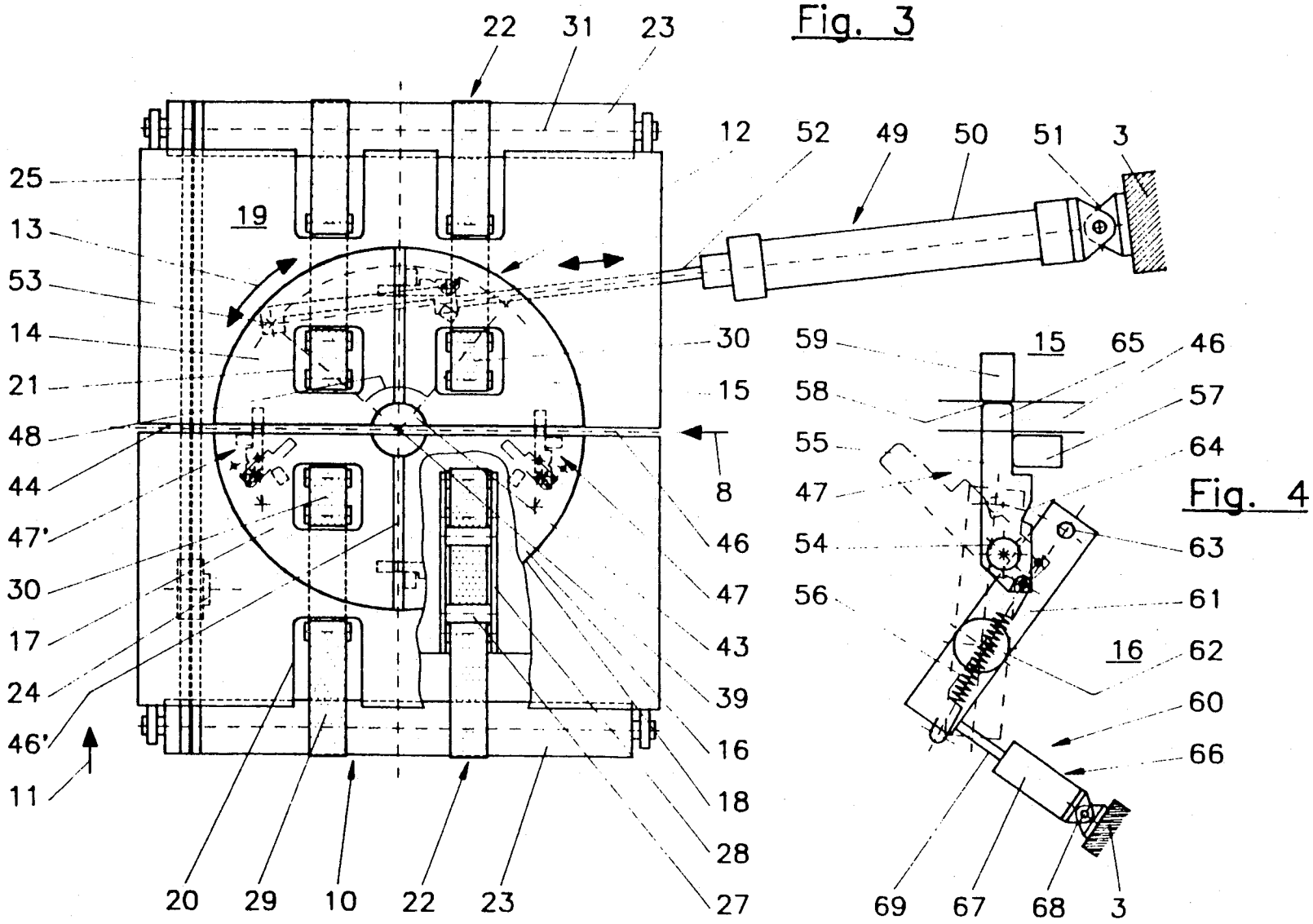
FIG. 3 is a view on the work table of the packaging station.
FIG. 4 shows a driving device and an unlocking device on an enlarged scale.

A linear drive in the form of a hydraulically or pneumatically actuatable piston cylinder drive serves as a rotary actuator 49 for the rotating disk 18, its cylinder 50 is articulated on the machine frame 3 by means of a hinge 51, and its piston rod 52 is secured to the lower side of a sector 14 by means of a hinge 53. When the piston rod 52 has exited the cylinder 50 as shown in FIG. 3, then the space 46 defined on one side by the sectors 14, 15 and on the other side by the sectors 16, 17 is situated above the guide channel 44. When, however, the piston rod 52 enters the cylinder 50, then the sector 14 is pivoted by an angle of rotation 48—clockwise in FIG. 3—driving the other three sectors 15, 16, 17. As a result, the space 46' defined between the sectors 17, 14 on the one side and between the sectors 16, 14 on the other side, reaches a position above the guide channel 44. When the piston rod 52 exits again, all the four sectors 14 through 17 are pivoted—counter-clockwise in FIG. 3—back into the position shown in FIG. 3. For this reason the direction of rotation 13 is marked with a double arrow.

In principle, the driving devices 47, 47' are equal in structure; the driving devices 47 or 47', respectively, associated with a space 46 or 46', respectively, are structured mirror-symmetrically relative to one another, as can be seen from FIG. 3. Therefore, only a driving device 47 shown on an enlarged scale in FIG. 4 is described. It has a latch 55 to be pivoted about a swivel hinge 54 on the lower side of a sector 16, which latch 55 is pulled into a position against an abutment 57 provided on the same sector 16 by means of a prestressed tension spring 56 equally secured to the lower side of the corresponding sector 16. In this position of rest to be designated as a driving position, it bears with a front end 58 against a driving stop 59 provided on the neighbouring sector 15. When all the four latches 55 are in their described position of rest, then all the four sectors 14 through 17 have the described space 46 or 46', respectively, relative to each other.

Two unlocking devices 60 are arranged in the machine frame 3, which are associated with the two driving devices 47, 47' fixing the space 46 or 46' above the guide channel 44. In the representation according to FIG. 3 these two unlocking devices are therefore arranged below the sectors 16, 17. They have a pivotable unlocking lever 61, which is supported pivotably about a stationary swivel bearing 62 in the machine frame 3. The unlocking lever 61 is structured as a two-armed lever having at one end an unlocking journal 63, which can be pivoted into a position against a stop surface 64 of the latch 55 when the unlocking lever 61 is pivoted about the swivel bearing 62, whereby the latch 55 can be pivoted out of the position bearing against the driving stop 59 and the stop 57 against the force of the tension spring 56—counter-clockwise in FIG. 4—such that the section 65 of the latch 55 bridging the space 46 is pivoted out of the area of the space 46.

An unlocking drive 66 serving as a hydraulically or pneumatically actuatable piston cylinder drive is provided to pivot the unlocking lever 61, its cylinder 67 is articulated on the machine frame 3 by means of a hinge 68 and its piston rod 69 engages with the unlocking lever 61 at the end of the latter opposite the unlocking journal 63. When the piston rod 69 exits, the unlocking journal 63 is in a position out of engagement with the latch 55. When the piston rod 69 is retracted, the latch 55 is pivoted out of its driving position shown in FIG. 4 and releases the space 46.

A welding unit 70 for the packaging tape 2 is arranged below the centre portion 43 serving as a guide of the rotating disk, it is associated with the guide channel 44 in this area and it is part of a welder 71 arranged in the machine frame 3. Details of the welder 71 with the welding unit 70 are not shown and are not explained, since they are common practice with so-called hooping machines or packaging machines, in which stacks of goods 1 are hooped with a packaging tape 2 of plastics material.

When a stack of goods 1 has been conveyed in conveying direction 11 onto the rotating disk 18, then a packaging tape 2, of which the ends have before been in the vicinity of the welding unit 70, i.e. below the centre portion 43, is slung around the outside of the stack of goods 1 by the entering device 6, while being guided in the guide duct in the guiding frame 9. From there it slides into the guide channel 44 in entering direction 8 and is held in the welding unit 70. Subsequently the packaging tape 2 is tensioned by driving the pair of rolls 7 of the entering device 6 in a reverse direction. Here the guide duct in the guiding frame 9, on the one hand, and the guide channel 44 below the work table 9 are opened, so that the packaging tape 2 can move out of the guide and surround the stack of goods 1. These devices for opening the guide duct and the guide channel 44 are generally used and known in practice. As a result of the tensioning the tape 2 spans the stack of goods 1, of which it does not surround the lower side—as can in particular be seen from FIG. 2—but is tensioned downwards towards the welding unit 70. Since such packaging tapes 2 consist of elastic, weldable plastics material, this is possible without any difficulty. In the welding unit 70 the tape is then welded and cut off. This above-described hooping operation is known and general practice. During this hooping operation the two driving devices 47, 47' situated in the vicinity of the guide channel 44 are removed from their driving position.

Subsequently these two driving devices 47, 47' are again moved into their driving position, in which the unlocking devices 60 are pivoted into their out-of-action position shown in FIG. 4. For conveying the stack of goods on the rotating disk 18 and possibly also during the hooping operation the conveying devices 10 are in their position pivoted upwards shown on the left in FIG. 2.

Prior to the rotating disk 18 being pivoted about the angle of rotation 48 of 90° by means of the rotary actuator, the conveying devices 10 are moved into their tilted position shown on the right in FIG. 2. To this effect the piston cylinder drives 35 serving as a linear drive are actuated such that the piston rods 34 exit, whereby the pivotable frames 28 are tilted downwards with the conveying belts 22 so that the conveying sections 30 move downwards out of the recesses 21 in the sectors 14 through 19. Then the rotary actuator 49 is actuated, so that the rotating disk 18 is pivoted about the angle of rotation 48. In this position the unlocking devices 60 are in turn operated, so that the driving devices 47, 47' now bridging the space 46' above the guide channel 44 are opened. Then another hooping operating takes place as already described. During this operation the conveying devices 10 may have been moved into their upwards pivoted conveying position. But they may as well be moved upwards only after the hooping operation has been finished. Then they are driven by actuation of the drive motor 44, so that the stack of goods 1 twice hooped with a packaging tape 2 is conveyed out of the packaging station 4 of the packaging machine. A new stack of goods 1 is simultaneously introduced in the packaging station 4. As a result of the above-described rotation of the rotating disk 18, i.e. alternately in opposite directions, the stacks of goods 1 initially always entering in the same sequence and direction leave the packaging station 4 each twisted by 180° relative to the one following next. In the case of stacks of journals with the fold, where the layers of paper are folded, on one side this has the advantage that they may subsequently be stacked more easily, since stacks of journals are thicker on the side of the fold than they are on the opposite side.

What is claimed is:

1. A packaging station of a packaging machine, in which a stack of goods (1) is hooped with a packaging tape (2), with a work table (19) to receive a stack of goods (1), with a conveying device (10) to convey a stack of goods (1) in a conveying direction (11) into a hooping position and out of this position, and with a tape guiding device (9, 44) to guide the packaging tape (2) around the stack of goods (1) in an entering direction (8) at right angles to the conveying direction (11), the work table (19) being provided with a tape guide channel (44) to be opened towards the stack of goods (1) and vertically aligned with the tape guiding device (9) and extending at right angles to the conveying direction (11), wherein the work table (19) is at least partially formed by a rotating disk (18), which is drivable to rotate about an axis of rotation (39), and which consists of at least four sectors (14, 15, 16, 17) having at least two spaces (46, 46'), which extend diametrically relative to the axis of rotation (39), which are selectively positioned in vertical alignment above the tape guide channel (44) and of which one is in each case situated above the tape guide channel (44), wherein the conveying device (10) has conveying sections (29, 30) protruding through recesses (20, 21) in the work table (19) and in the sectors (14 through 17) of the rotating disk (18) and wherein devices are provided to lower the conveying sections (28, 30) of the conveying device (10) out of the rotating disk (18') and the work table (18).

2. A packaging station according to claim 1, wherein the sectors (14, 15, 16, 17) are supported in guideways (40, 42) of the work table (19) formed concentrically relative to the axis of rotation (39).

3. A packaging station according to claim 1, wherein only one sector (14) is drivable to rotate, and wherein the sectors are coupled with each other by means of driving devices (47, 47') bridging the spaces (46, 46') and movable out of the vicinity of the spaces (46, 46').

4. A packaging station according to claim 3, wherein each driving device (47, 47') has a latch (55), which is pivotably supported on a sector (14, 15, 16, 17) and which, in a driving position, bears with a section (65) bridging one space (46, 46') two spaces (46, 46') towards a neighboring sector (15) against a driving stop (59) on the neighboring sector (15) and which is pivotable out of this driving position by means of an unlocking device (60) such that the section (65) no longer bridges said one space (46, 46') of said at least two spaces (46 46').

5. A packaging station according to claim 4, wherein, in its driving position, the latch (55) bears with a prestressed spring (56) against a stop (57) of the sector (16) bearing the latch (55).

6. A packaging station according to claim 4, wherein the unlocking device (60) has a two-armed unlocking lever (61), which has a first end and a second end and is supported in a stationary swivel bearing (62), of which an unlocking drive (66) engages with said first end and of which said second end can be brought into an unlocking engagement with the latch (55).

7. A packaging station according to claim 1, wherein the conveying device (10) has at least one drivable conveying belt (22), which is in each case arranged ahead of and behind the tape guide channel (44) in conveying direction (11) and of which at least one conveying section (30) protrudes through at least one of said recesses (21) in said sectors (14, 15, 16, 17) towards the side of the stack of goods (1), which conveying section (30) is movable away from the side of the stack of goods (1) out of said at least one recess (21).

8. A packaging station according to claim 7, wherein two conveying belts (22) are arranged on either side of the tape guide channel (44) in conveying direction (11), each conveying section (30) of each of the conveying belts (22) being arranged in one of said recesses (21) of said sectors (14, 15, 16 17).

9. A packaging station according to claim 7, wherein said at least one conveying belt (22) is supported on a pivotable frame (28) by means of deflection pulleys (27), which frame (28) is pivotable out of the rotating disk (18).

10. A packaging station according to claim 9, wherein said at least one conveying belt (22) is drivable by means of a drive shaft (23) drivable to rotate about a stationary axis (31), and wherein the pivotable frame (28) is pivotable about said stationary axis (31).

11. A packaging station of a packaging machine, in which a stack of goods (1) is hooped with a packaging tape (2), with a work table (19) to receive a stack of goods (1), with a conveying device (10) to convey a stack of goods (1) in a conveying direction (11) into a hooping position and out of this position, and with a tape guiding device (9, 44) to guide the packaging tape (2) around the stack of goods (1) in an entering direction (8) at right angles to the conveying direction (11), the work table (19) being provided with a tape guide channel (44) to be opened towards the stack of goods and vertically aligned with the tape guiding device and extending at right angles to the conveying direction (11), wherein the work table (19) is at least partially formed by a rotating disk (18), which is drivable to rotate about an axis of rotation (39), and which consists of at least four sectors (14, 15, 16, 17) having at least two spaces (46, 46'), which extend diametrically relative to the axis of rotation (39), which are selectively positioned in vertical alignment above the tape guide channel (44) and of which one is in each case situated above the tape guide channel (44), wherein only one sector (14) can be driven to rotate, said conveying device having sections protruding through openings in said sectors wherein the sectors are coupled with each other by means of driving devices (47, 47') bridging the spaces (46, 46') and means for moving said driving devices out of the vicinity of the spaces (46, 46'), and wherein devices are provided to lower the conveying sections (28, 30) of the conveying device (10) out of the rotating disk (18).

12. A packaging station according to claim 11, wherein the sectors (14, 15, 16, 17) are supported in guideways (40, 42) of the work table (19) formed concentrically relative to the axis of rotation (30).

13. A packaging station according to claim 11, wherein each driving device (47, 47') has a latch (55), which is pivotably supported on a sector (14, 15, 16, 17) and which, in a driving position, bears with a section (65) bridging one space (46, 46' of said at least two spaces (46, 46') towards a neighboring sector (15) against a driving stop (59) of the neighboring sector (15) and which is pivotable out of this driving position by means of an unlocking device (60) such that the section (65) no longer bridges said one space, 46, 46') of said at least two spaces (46, 46').

14. A packaging station according to claim 13, wherein each driving position, the latch (55) bears with a prestressed spring (56) against a stop (57) of the sector (16) bearing the latch (55).

15. A packaging station according to claim 13, wherein the unlocking device (60) has a two-armed unlocking lever (61), which has a first end and a second end and is supported in a stationary swivel bearing (62), of which an unlocking drive (66) engages with said first end and of which said second end can be brought into an unlocking engagement with the latch (55).

16. A packaging station according to claim 11, wherein the conveying device (10) has at least one drivable conveying belt (22), which is in each case arranged ahead of and behind the tape guide channel (44) in conveying direction (11) and of which at least one conveying section (30) protrudes through a recess (21) in a sector (14, 15, 16, 17) towards the side of the stack of goods (1), which conveying section (30) is movable away from the side of the stack of goods (1) out of the sector (14, 15, 16, 17).

17. A packaging station according to claim 16, wherein two conveying belts (22) are arranged on either side of the tape guide channel (44) in conveying direction (11), each conveying section (30) of each of the conveying belts (22) being arranged in a recess (20) of a sector (14, 15, 16 17).

18. A packaging station according to claim 16, wherein at least one conveying belt (22) is supported on a pivotable frame (28) by means of deflection pulleys (27), which frame (28) can be pivoted out of the rotating disk (18).

19. A packaging station according to claim 18, wherein said at least one conveying belt (22) is drivable by means of a drive shaft (23) drivable to rotate about a stationary axis (31), and wherein the pivotable frame (28) is pivotable about said stationary axis (31).

20. A packaging station of a packaging machine, in which a stack of goods (1) is hooped with a packaging tape (2), with a work table (19) to receive a stack of goods (1), with a conveying device (10) to convey a stack of goods (1) in a conveying direction (11) into a hooping position and out of this position, and with a tape guiding device (9, 44) to guide the packaging tape (2) around the stack of goods (1) in an entering direction (8) at right angles to the conveying direction (11), the work table (19) being provided with a tape guide channel (44) to be opened towards the stack of goods (1) and vertically aligned with the tape guiding device (9) and extending at right angles to the conveying direction (11), wherein the work table (19) is at least partially formed by a rotating disk (18), which is drivable to rotate about an axis of rotation (39), and which consists of at least four sectors (14, 15, 16, 17) having at least two spaces (46, 46'), which extend diametrically relative to the axis of rotation (39), which are selectively positioned in vertical alignment above the tape guide channel (44) and of which one is in each case situated above the tape guide channel (44), wherein only one sector (14) can be driven to rotate, wherein the sectors are coupled with each other by means of driving devices (47, 47') bridging the spaces (46, 46') and movable out of the vicinity of the spaces (46, 46'), wherein each driving device (47, 47') has a latch (55), which is pivotably supported on a sector (14, 15, 16, 17) and which, in a driving position, bears with a section (65) bridging one space (46, 46') towards a neighboring sector (15) against a driving stop (59) on the neighboring sector (15) and which is pivotable out of this driving position by means of an unlocking device (60) such that the section (65) no longer bridges said one space (46, 46') of said at least two spaces (46, 46') and wherein devices are provided to lower the conveying device (10) out of the vicinity of the rotating disk (18).

21. A packaging station according to claim 20, wherein the sectors (14, 15, 16, 17) are supported in guideways (40, 42) of the work table (19) formed concentrically relative to the axis of rotation (39).

22. A packaging station according to claim 20, wherein in its driving position, the latch (55) bears with a prestressed spring (56) against a stop (57) of the sector (16) bearing the latch (55).

23. A packaging station according to claim 20, wherein the unlocking device (60) has a two-armed unlocking lever (61), which is supported in a stationary swivel bearing (62), of which an unlocking drive (66) engages with the one end and of which the other end can be brought into an unlocking engagement with the latch (55).

24. A packaging station according to claim 20, wherein the conveying device (10) has at least one drivable conveying belt (22), which is in each case arranged ahead of and behind the tape guide channel (44) in conveying direction (11) and of which at least one conveying section (30) protrudes through a recess (20) in a sector (14, 15, 16, 17) towards the side of the stack of goods (1), which can be moved away from the side of the stack of goods (1) out of the sector (14, 15, 16, 17).

25. A packaging station according to claim 24, wherein two conveying belts (22) are arranged on either side of the tape guide channel (44) in conveying direction (11), each conveying section (30) of each of the conveying belts (22) being arranged in a recess (20) of a sector (14, 15, 16 17).

26. A packaging station according to claim 24, wherein at least one conveying belt (22) is supported on a pivotable frame (28) by means of deflection pulleys (27), which frame (28) can be pivoted out of the rotating disk (18).

27. A packaging station according to claim 26, wherein said at least one conveying belt (22) is drivable by means of a drive shaft (23) drivable to rotate about a stationary axis (31), and wherein the pivotable frame (28) is pivotable about the axis (31).

* * * * *